US007951463B2

(12) United States Patent
Hirata et al.

(10) Patent No.: US 7,951,463 B2
(45) Date of Patent: May 31, 2011

(54) WATER COLLAPSIBLE ALUMINUM FILM

(75) Inventors: Akisuke Hirata, Chiba-ken (JP); Shinji Isoda, Chiba-ken (JP); Yutaka Kadowaki, Chiba-ken (JP); Katsuhiko Mushiake, Tokyo (JP)

(73) Assignee: Ulvac, Inc., Kanagawa (JP)

( * ) Notice: Subject to any disclaimer, the term of this patent is extended or adjusted under 35 U.S.C. 154(b) by 1167 days.

(21) Appl. No.: 10/549,034

(22) PCT Filed: Mar. 4, 2005

(86) PCT No.: PCT/JP2005/003714

§ 371 (c)(1),
(2), (4) Date: May 17, 2006

(87) PCT Pub. No.: WO2005/087968

PCT Pub. Date: Sep. 22, 2005

(65) Prior Publication Data

US 2006/0240271 A1 Oct. 26, 2006

(30) Foreign Application Priority Data

Mar. 10, 2004 (JP) ..... 2004-067829

(51) Int. Cl.
*B32B 15/20* (2006.01)

(52) U.S. Cl. ..... 428/553; 428/570; 428/642; 428/650; 428/933; 428/937

(58) Field of Classification Search ..... None
See application file for complete search history.

(56) References Cited

U.S. PATENT DOCUMENTS 4,434,541 A * 3/1984 Powers, Jr. ..... 361/1
4,687,510 A * 8/1987 Cheney et al. ..... 75/331
4,900,639 A * 2/1990 Hodes et al. ..... 428/610
4,943,492 A * 7/1990 Holroyd et al. ..... 428/654

(Continued)

FOREIGN PATENT DOCUMENTS

EP 0248960 A1 * 12/1987

(Continued)

OTHER PUBLICATIONS

K. Kondoh et al., "Analysis of tin behaviour on surface of rapidly solidified aluminum alloy powder particles during heating", Powder Metallurgy, 2001, vol. 44, No. 3, pp. 253-259.*

(Continued)

*Primary Examiner* — John J Zimmerman
(74) *Attorney, Agent, or Firm* — Arent Fox LLP

(57) ABSTRACT

In an Al composite material collapsible in the presence of moisture, the external surface of small pieces or powder constructed from a single or a plurality of crystalline grains of Al or an Al alloy is covered with a film of a low melting point metal or alloy selected from the group consisting of In, Sn, combinations of In and Sn, and alloys thereof. The content of the foregoing low melting point metal or alloy ranges from 0.1 to 20% by mass on the basis of the total mass of the composite material. A component member for a film-forming chamber is also provided, which is provided with a water-collapsible Al film on the surface thereof. Film-forming operations are continued over a long period of time using the component member for a film-forming chamber provided with the water-collapsible Al film and then film-forming materials can be recovered from the component member on which the film-forming materials are deposited in a substantial thickness.

2 Claims, 5 Drawing Sheets

U.S. PATENT DOCUMENTS

2002/0192487 A1* 12/2002 Muramatsu et al. ..... 428/612

FOREIGN PATENT DOCUMENTS

| | | | |
|---|---|---|---|
| JP | 61-6421 | * | 1/1986 |
| JP | 62-218529 | * | 9/1987 |
| JP | 63-2801 A | | 1/1988 |
| JP | 03-264602 A | | 11/1991 |
| JP | 7-26373 A | | 1/1995 |
| JP | 07-238331 A | | 9/1995 |
| JP | 10-168503 A | | 6/1998 |
| JP | 2001-338647 | * | 12/2001 |
| JP | 2002-161325 | | 6/2002 |
| JP | 2003-138367 | * | 5/2003 |
| JP | 2004-114123 A | | 4/2004 |

OTHER PUBLICATIONS

Computer generated translation of JP 2001-338647. Dec. 18, 2009.*

* cited by examiner

【Fig. 1】
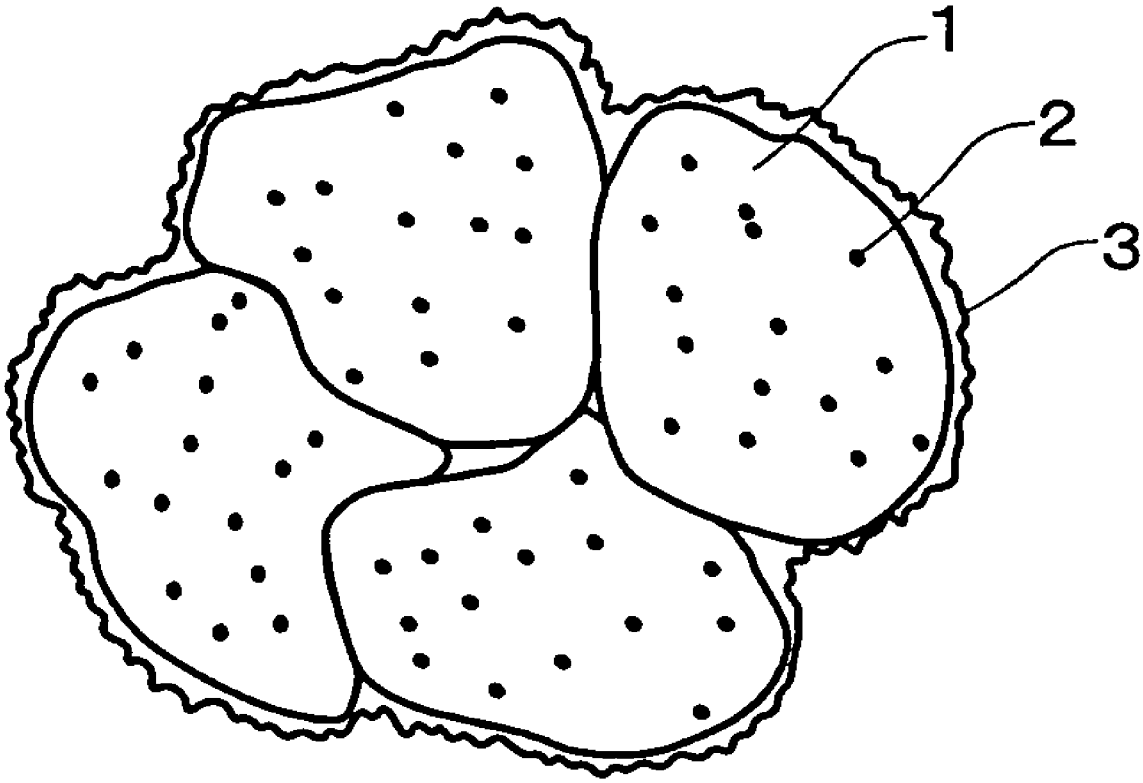

【Figs. 2】
(a)
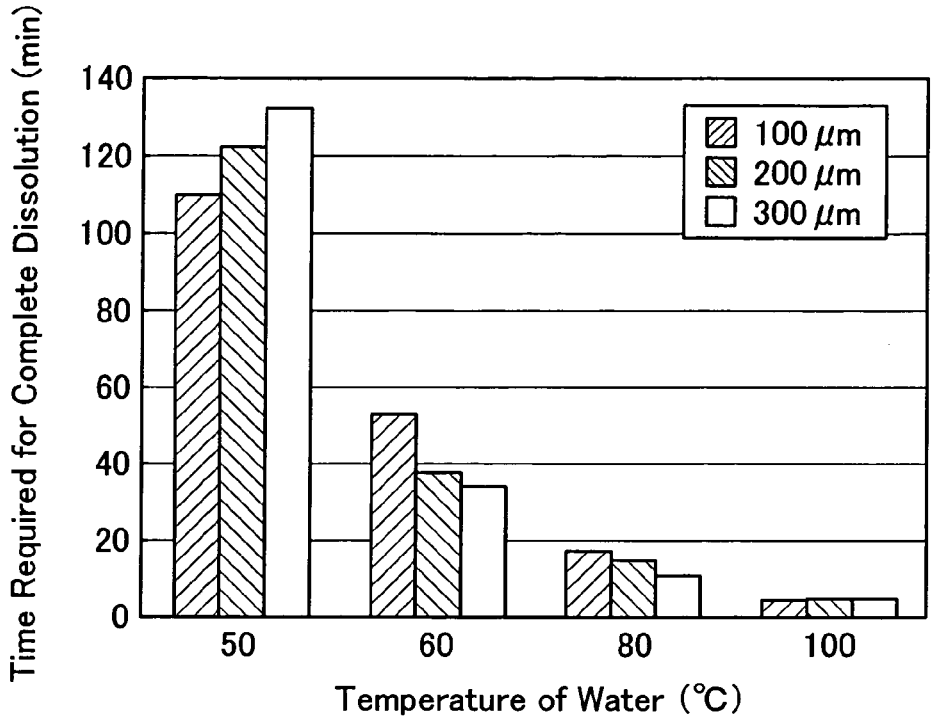
(b)
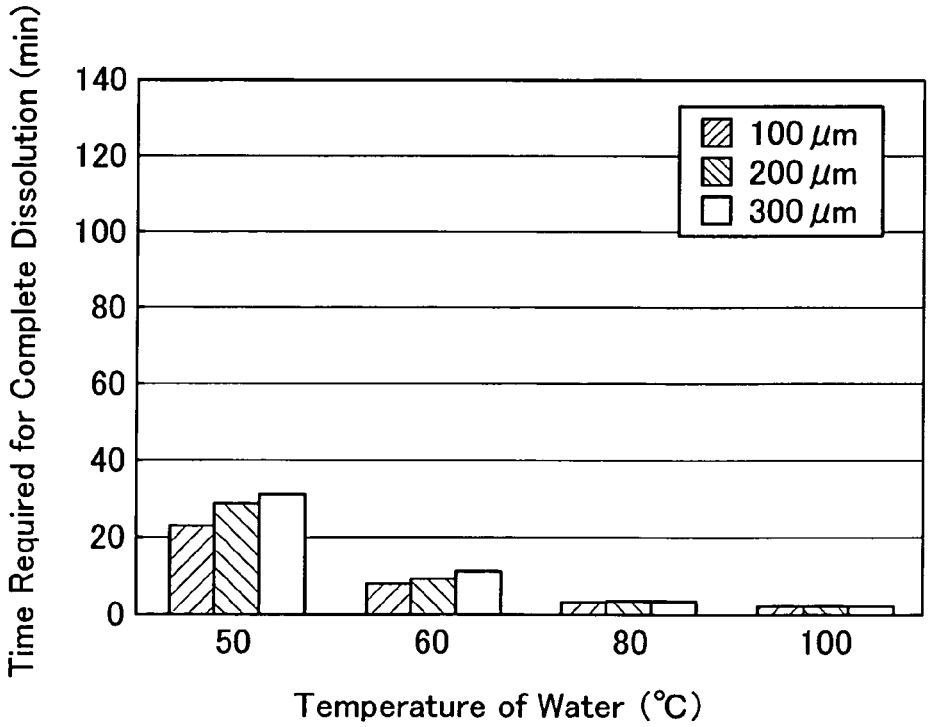

【Figs.3】
(a)
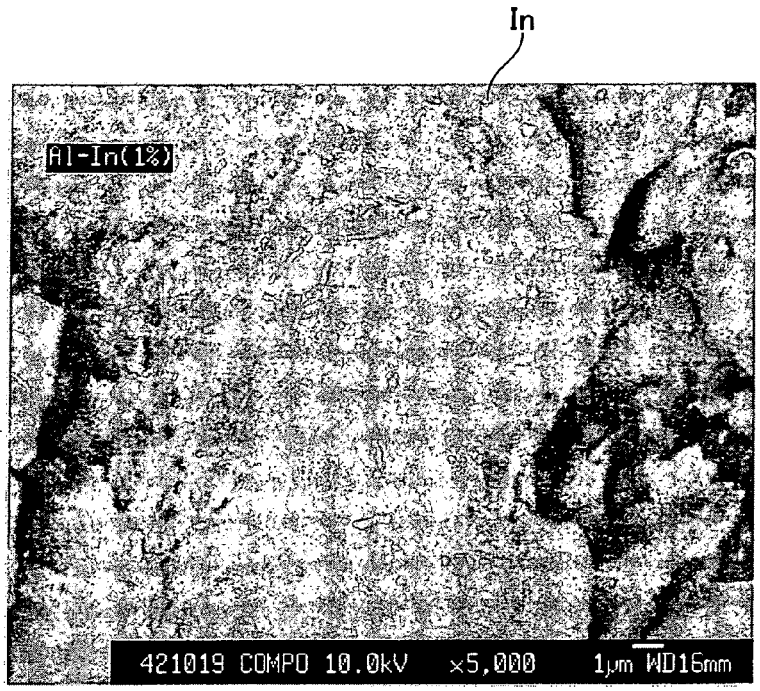
Al−1%In
(b)
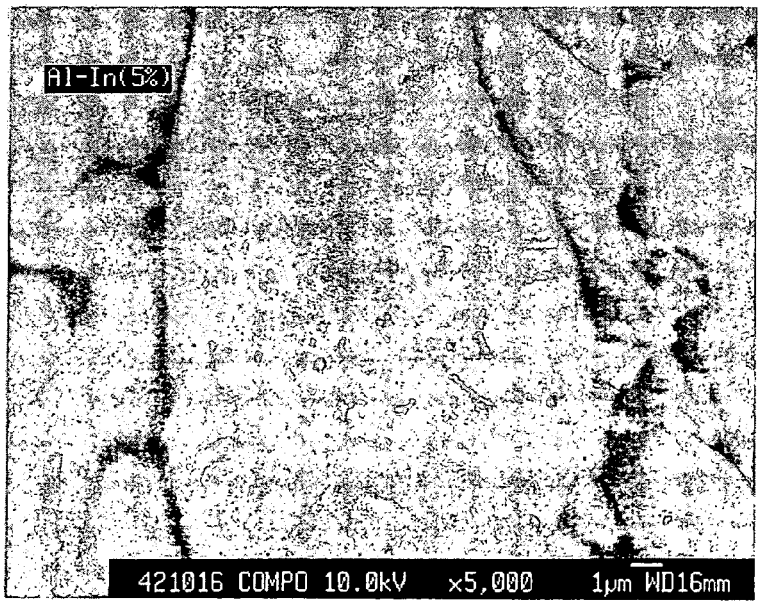
Al−5%In

【Figs.4】
(a) Al-1%In
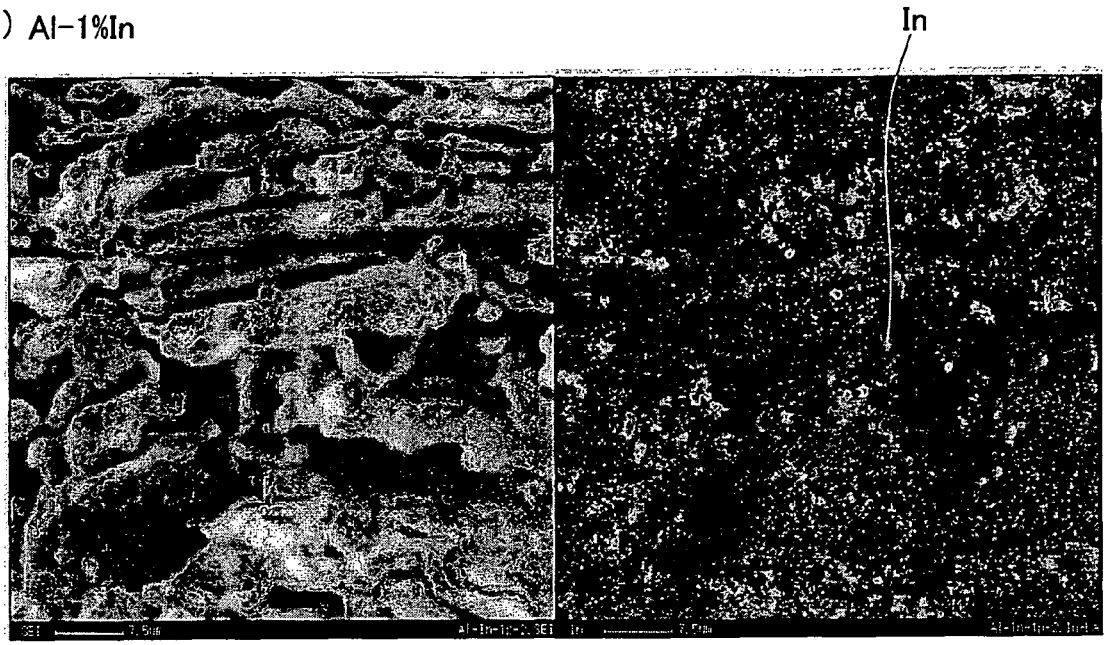
Reflection Electron Diffraction Image  Characteristic X-Ray Image of In
(b) Al-5%In
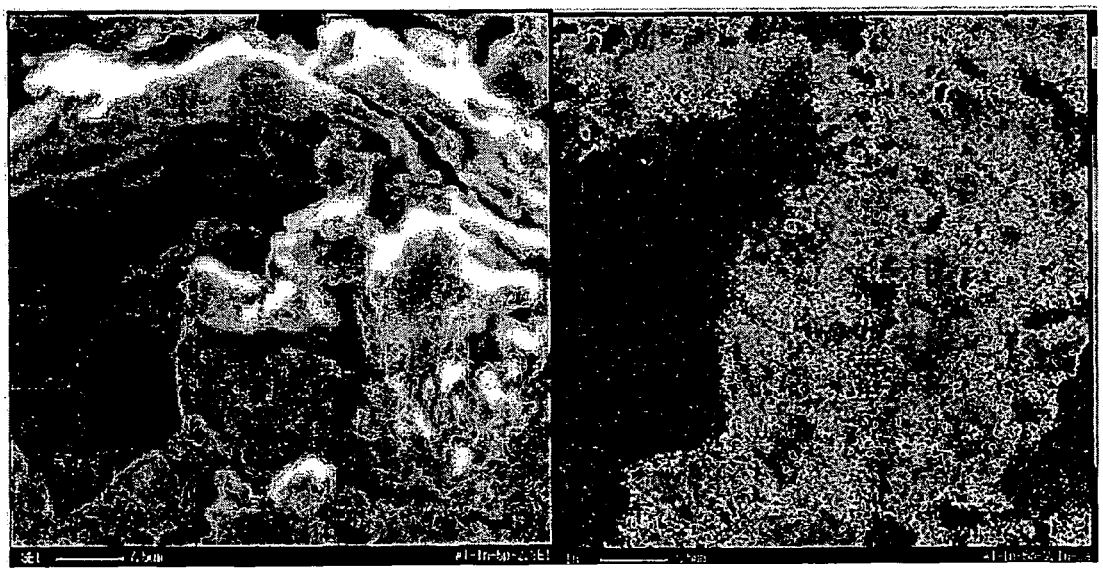
Reflection Electron Diffraction Image  Characteristic X-Ray Image of In 【Figs.5】
(a)
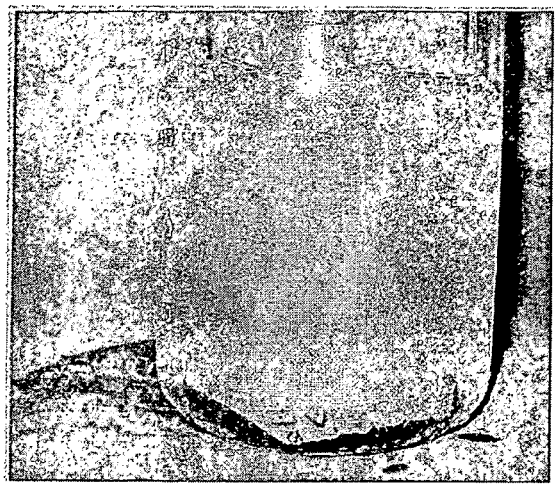
A vigorous hydrogen gas-generating reaction takes place immediately after the dipping;
(b)
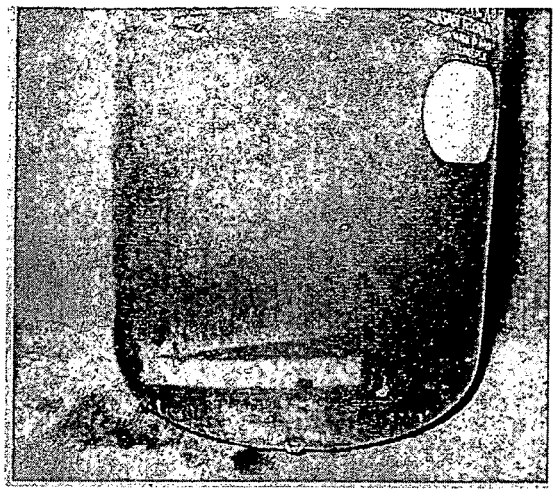
As the reaction further proceeded, the water is blackened due to the presence of In;
(c)
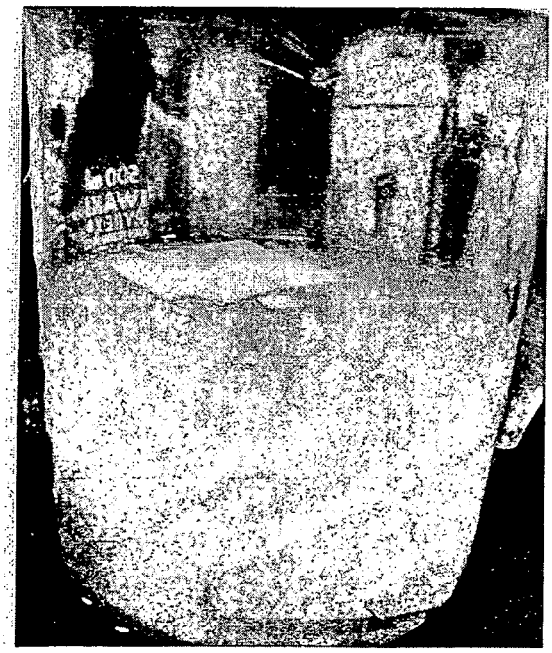
The alloy film is peeled off and it is lifted out of the water.

WATER COLLAPSIBLE ALUMINUM FILM

CROSS-REFERENCE TO RELATED APPLICATION

This application is a National Stage entry of International Application Number PCT/JP2005/003714, filed Mar. 4, 2005. The disclosure of the prior application is hereby incorporated herein in its entirety by reference.

TECHNICAL FIELD

The present invention relates to a water-collapsible aluminum (hereunder referred to as "Al") composite material, Al powder and an Al film consisting of this water-collapsible Al film, and methods for the preparation of these substances or materials as well as a component member for constituting a film-forming chamber using the water-collapsible Al film and a method for recovering film-forming materials using the component member.

BACKGROUND ART

In a film-forming apparatus for forming a thin film on a semiconductor or electronics-related machinery and tools according to, for instance, the sputtering technique, the vacuum evaporation technique, the ion-plating technique and the CVD technique, a film of a metal or a metal compound constituting a film-forming material is inevitably deposited on or adhered to certain component members of a film-forming chamber arranged within such a film-forming apparatus during a film-forming process. For this reason, the component member for the film-forming chamber comprises, for instance, a baffle plate for preventing any deposition of a film on the interior of the vacuum chamber other than a substrate, a mask which permits the deposition of a film only on the desired portions of a substrate, a tray for transporting the substrate and/or a shutter and accordingly, a film having a composition identical to that of a desired thin film (one to be deposited on the substrate) is deposited on these members.

The thickness of the film inevitably deposited on these component members for the film-forming chamber increases in proportion to the increase in the operating time. In addition, these members are in general repeatedly used after the removal of such films deposited thereon. Such deposited films may be peeled off from these members for the film-forming chamber in the form of particles due to the action of internal stresses and/or repeated thermal history, these films peeled off are then deposited on the surface of a substrate and this becomes a cause of various defects of a desired film deposited on the substrate. Accordingly, these component members for the film-forming chamber are detached from the film-forming apparatus at such a stage that the deposited film is not yet peeled off from the member, the members are then washed to thus eliminate the deposited films, these members are subsequently subjected to a surface-finishing treatment and then they can thus be reused. The cycle consisting of the foregoing steps are in general repeated at regular intervals.

There have in general been used, for instance, a valuable metal such as Al, Mo, Co, W, Pd, Nd, In, Ta, Re, Au, Pt, Se or Ag, as a film-forming material. In this connection, there has been desired for the development or establishment of any technique for recovery and recycling treatments for these film-forming materials, in order to reduce the amounts of these materials, which are not used in the film-forming processes and disposed or abandoned, to a level as low as possible.

For instance, the baffle plate is used for the prevention of the deposition of any film-forming material onto the internal wall of the apparatus other than the substrate and a variety of component members for the film-forming chamber, arranged in the film-forming apparatus, but it is presently common that the plate is reused after the removal of any deposits thereon during the film-forming stage. As methods generally used for the removal of these deposits, there have been known, for instance, a sand-blasting method; a wet etching method which makes use of an acid or an alkali; a peeling method which makes use of the hydrogen embrittlement with, for instance, hydrogen peroxide; and a method for peeling the same while making use of the electrolysis technique. In this connection, however, the baffle plate would be damaged, through the dissolution of the same, to a certain extent during the process for the removal of such deposits and therefore, this may in turn limit the number of the repeated use of the same.

In this respect, only a small amount of blasting dust is generated during the foregoing sand-blasting step and the waste fluid generated in the foregoing treatments with a liquid containing a chemical such as an acid or an alkali contains the film, which had been deposited on the foregoing component members and peeled off therefrom during the treatments, in only a low concentration. Accordingly, these materials have in general been disposed as waste materials, at present, because of an increase in the cost required for recycling the same.

Moreover, the foregoing treatment with a liquid containing a chemical not only requires the use of an expensive chemical, but also requires the expensive post-treatment of the used chemical-containing liquid. Accordingly, there has also been desired for the reduction of the amount of such a chemical-containing liquid as low as possible and this would likewise be quite favorable from the viewpoint of the prevention of any environmental pollution. Moreover, when carrying out the foregoing treatment with a chemical-containing liquid, the film-forming materials may be converted into different chemical substances through the treatments and accordingly, an additional cost would further be required for the recovery of only the film-forming materials from the deposits peeled off from the foregoing component members. For this reason, the subjects to be recovered at present are only the film-forming materials each having a unit price comparable to the recovery cost thereof.

In addition, there have conventionally been developed a variety of methods for the generation of hydrogen gas. For instance, there have been known a partial oxidation method or a reforming method which makes use of natural gases or petroleum; a method for electrolyzing an aqueous solution of NaCl or water; and a method which makes use of a hydrogen-generating alloy material (see, for instance, Patent Article 1 specified below). At present, however, there has not yet been developed any satisfactory hydrogen-generating method.

More specifically, the method which makes use of natural gases or petroleum suffers from various problems such that it never provides hydrogen gas having a high purity, that it requires the use of a high temperature on the order of 1000 to 1500° C. and that the raw materials to be used are naturally-occurring ones or fossil fuels which would be in danger of depletion in the not very distant future. In addition, the foregoing electrolysis method likewise suffers from a variety of drawbacks such that the method requires a high production cost because of the consumption of a great quantity of electric power and that even when employing the solar energy for the reduction of the production cost, the efficiency of the production thereof is very low and it requires a high facility investment. Moreover, the method using a hydrogen-generating alloy material likewise suffers from such a problem that it cannot achieve any desired low voltage to be used and any desired stability thereof.

In this respect, the higher the natural electrode potential of a material in an aqueous solution, the wider the applicable range of the anodic protection thereof and the higher the corrosion-protecting effect thereof. Accordingly, an Al—In alloy has attracted much attention because of its low potential and high stability. However, there has not yet been developed any satisfactory Al—In alloy and accordingly, there has been desired for the development of a material which permits the occurrence of a stable and long-lasting reaction which may take place at a lower potential.

Patent Article 1: Japanese Un-Examined Patent Publication 2002-161325 (Claims)

DISCLOSURE OF THE INVENTION

It is an object of the present invention to solve the foregoing problems associated with the conventional techniques and more specifically to provide an Al composite material which is collapsible in a moisture-containing atmosphere, an Al film consisting of this Al composite material, Al powder consisting of the same and methods for the preparation of these materials or substances as well as a component member for constituting the film-forming chamber of a film-forming apparatus and a method for recovering film-forming materials using the component member.

According to a first aspect of the present invention, there is provided a water-collapsible Al composite material wherein the external surface of small lumps (or pieces) or powder constructed from a single or a plurality of grains of Al or an Al alloy is covered with a film of a low melting point metal or alloy selected from the group consisting of indium (hereunder referred to as "In"), tin (hereunder referred to as "Sn"), any combination of In and Sn, and alloys thereof. If an Al composite material has such a composition and such a structure specified above, the composite material is easily disintegrated or collapsed while generating hydrogen gas, within a moisture-containing atmosphere.

The water-collapsible Al composite material is also characterized in that the content of the foregoing low melting point metal or alloy such as In, Sn, a combination of In and Sn, or an alloy thereof ranges from 0.1 to 20% by mass on the basis of the total mass of the composite material. If the content of the foregoing low melting point metal or alloy such as In, Sn, a combination of In and Sn or an alloy thereof is less than 0.1% by mass, the extent of the inverse segregation phenomenon is reduced, the area on which any inverse segregation layer is not formed is in turn increased and the resulting composite material is not easily and efficiently disintegrated in a moisture-containing atmosphere. Moreover, the use of these elements or alloys in an amount exceeding the upper limit specified above not only leads to an increase of the natural potential, but also results in a simple increase of the thickness of the inverse segregation layer. Furthermore, the use thereof in such a high content never improves the water-collapsibility of the resulting composite material and leads to an increase in the production cost. Accordingly, the upper limit of the content thereof is preferably on the order of about 20% by mass. In this connection, the term "inverse segregation (layer)" will be described in detail later.

According to a second aspect of the present invention, there is also provided a method for the preparation of the foregoing water-collapsible Al composite material according to the first aspect of the present invention, which comprises the steps of adding, to Al or an Al alloy, a low melting point metal or alloy selected from the group consisting of In, Sn, combinations of In and Sn, and alloys thereof in an amount ranging from 0.1 to 20% by mass to thus give a raw material; fusing or melting the raw material in such a manner that the material has a uniform composition; and then quenching the molten raw material in a non-oxidizing atmosphere to thus induce or cause the inverse segregation of the foregoing low melting point metal or alloy on the external surface of small pieces or powder constructed from a single or a plurality of crystalline grains of Al or an Al alloy to thus cover the external surface of the small pieces or powder with the low melting point metal or alloy selected from the group consisting of the members listed above. In this connection, the added amount of the low melting point metal or alloy such as In is limited to the range of from 0.1 to 20% by mass for the same reasons discussed above in detail.

According to a third aspect of the present invention, there is likewise provided a water-collapsible Al film which consists of the foregoing water-collapsible Al composite material according to the first aspect of the present invention. This water-collapsible Al film may be a thermally sprayed water-collapsible Al film formed by the molten deposition (or spray-coating or thermal spraying) technique.

The method for the preparation of such a water-collapsible Al film according to the third aspect of the present invention comprises the steps of adding, to Al or an Al alloy, a low melting point metal or alloy selected from the group consisting of In, Sn, combinations of In and Sn, and alloys thereof in an amount ranging from 0.1 to 20% by mass to thus give a raw material; fusing or melting the raw material in such a manner that the material has a uniform composition; thermally spraying the resulting material on the surface of a substrate in a non-oxidizing atmosphere; and then quenching the thermally sprayed raw material to solidify the same and to thus give a desired film.

According to a fourth aspect of the present invention, there is also provided water-collapsible Al powder which consists of the foregoing water-collapsible Al composite material according to the first aspect of the present invention.

According to a fifth aspect of the present invention, there is also provided a method for the preparation of the water-collapsible Al powder according to the fourth aspect of the present invention, which comprises the steps of adding, to Al or an Al alloy, a low melting point metal or alloy selected from the group consisting of In, Sn, combinations of In and Sn and alloys thereof in an amount ranging from 0.1 to 20% by mass to thus give a raw material; fusing or melting the raw material in such a manner that the material has a uniform composition; and then quenching and solidifying the resulting material by spraying the same within a non-oxidizing atmosphere to thus form a desired powdery product. In this case, the added amount of the low melting point metal or alloy such as In is limited to the range of from 0.1 to 20% by mass for the same reasons discussed above in detail.

According to a sixth aspect of the present invention, there is also provided a component member for the film-forming chamber of a film-forming apparatus which is characterized in that it comprises, on the surface thereof, the foregoing water-collapsible Al film according to the third aspect of the present invention.

According to a seventh aspect of the present invention, there is also provided a method for recovering film-forming materials, which is characterized by the use of a component member for a film-forming chamber provided with the foregoing water-collapsible Al film on the surface thereof, as the member for the film-forming chamber of a film-forming apparatus in which a film is formed on a subject to be treated, and which comprises the steps of detaching the component member for the film-forming chamber provided thereon with the film-forming materials deposited on the surface thereof in a substantial thickness after the practice of film-forming processes over a long time period; and then exposing the component member to a moisture-containing atmosphere, for instance, an atmosphere containing water, water vapor and/or an aqueous solution to induce the disintegration of the water-collapsible Al film and to thus peel off and recover only the film deposited on the component member and consisting of the film-forming materials from the surface of the component member for the film-forming chamber.

In the water-collapsible Al composite material according to the present invention, the external surface of small lumps (or pieces) or powder constructed from a single or a plurality of crystalline grains of Al or an Al alloy is covered with a film of a low melting point metal or alloy selected from the group consisting of In, Sn, combinations of In and Sn, and alloys thereof and therefore, this Al composite material possesses such properties that it can efficiently be disintegrated or collapsed in a moisture-containing atmosphere. For this reason, a film or the like consisting of this Al composite material may undergo efficient disintegration while generating hydrogen gas in the presence of moisture and accordingly, if the film is applied to a component member for a film-forming member (such as a baffle plate), a film consisting of film-forming materials inevitably deposited on, for instance, such a baffle plate during the film-forming process can be peeled off or separated from the plate through the disintegration of the Al composite film and valuable metals included in the film-forming materials can efficiently be recovered from the deposited film thus peeled off. In addition, the water-collapsible Al composite material as well as the Al film, thermally sprayed Al film or Al powder consisting of the composite material can easily be prepared by simple processes at low production cost.

BRIEF DESCRIPTION OF THE DRAWINGS

FIG. 1 is a schematic diagram showing the composition and structure of an Al—In composite material according to the present invention.

FIG. 2 is a graph showing the solubility characteristics of an Al—In spray-coated film (or an Al—In deposited film) with respect to water. More specifically, FIG. 2(*a*) is a bar graph showing the solubility characteristics of an Al—In (1%) spray-coated film as a function of the temperature of warm water, while FIG. 2(*b*) is a bar graph showing the solubility characteristics of an Al—In (5%) spray-coated film as a function of the temperature of warm water.

FIG. 3 is an SEM micrograph of the Al—In spray-coated film prepared in Example 1. More specifically, FIG. 3(*a*) shows such an SEM micrograph of an Al—In (1%) spray-coated film and FIG. 3(*b*) shows such an SEM micrograph of an Al—In (5%) spray-coated film.

FIG. 4 is a photograph showing EPMA images observed on the rupture surface of the Al—In spray-coated films prepared in Example 1, wherein FIG. 4(*a*) relates to an Al—In (1%) spray-coated film and FIG. 4(*b*) relates to an Al—In (5%) spray-coated film.

FIG. 5(*a-c*) shows photographs each illustrating the processes, in which the deposited film is peeled off from a substrate, observed using a substrate covered with an Al—In (1%) alloy spray-coated film formed according to procedures similar to those used in Example 1.

BEST MODE FOR CARRYING OUT THE INVENTION

According to the water-collapsible Al composite material of the present invention, the external surface of small lumps (or pieces) or powder constructed from a single or a plurality of crystalline grains of Al or an Al alloy is covered with a film of a low melting point metal or alloy selected from the group consisting of In, Sn, combinations of In and Sn, and alloys thereof and accordingly, the water-collapsible Al composite material can easily be disintegrated or collapsed in a moisture-containing atmosphere such as those containing, for instance, water, water vapor or an aqueous solution. Al used in the present invention may be one containing impurities, but preferably used herein is pure Al. The present invention will hereunder be described in detail with reference to preferred embodiments of the present invention while taking Al—In systems and optionally taking Al—In and/or Sn systems by way of typical examples.

In the Al—In composite material, the electrochemical potential difference between Al and In is in general quite high, but any ionization of Al does not proceed in the presence of a naturally oxidized Al film. If the naturally oxidized Al film is once destroyed and Al is directly combined with In, the potential difference would strongly accelerate the ionization of Al. At this stage, In is present in the Al—In system without undergoing any chemical change. Thus, it would be necessary to cover the surface of Al with a film of In while preventing the formation of any natural oxidized film of Al. The metal In has a low melting point (157° C.) and never forms any solid solution with Al and accordingly, it is liable to cause an inverse segregation phenomenon upon the solidification of the Al—In system. When applying a material in which In is uniformly dispersed to the thermal spraying technique, while paying special attention to the difference in density between Al and In, an inverse segregation phenomenon takes place due to the quenching and solidification as well as the compressive effect thereof and accordingly, the external surface of the thermally sprayed particles or grains can be covered with the inverse segregation layer of In.

For this reason, according to a preferred embodiment of the present invention, an Al spray-coated film is, for instance, formed on the surface of a substrate to be processed in a non-oxidizing atmosphere according to any known thermal spray (or molten deposition) technique using an Al—In system in which In is uniformly dispersed in the Al matrix. As schematically shown in, for instance, attached FIG. 1, the resulting Al—In spray-coated film consists of an Al—In composite material comprising at least one Al—In grain (in FIG. 1, only four Al—In crystalline grains are illustrated) each of which consists of an Al crystalline grain 1 and In crystalline grains 2 dispersed within the Al crystalline grain 1 and an inverse segregation layer 3 which covers the external surface of the Al crystalline grain 1.

In this respect, it would be considered that such a structure is formed by exuding In present in the Al crystalline grain to the surface of the crystalline grain due to the quenching and solidification effect during the thermal spraying step as well as the volumetric shrinkage of the Al grain to exude In present in the Al crystalline grain to the external surface of the grain and to thus form an inverse segregation layer and accordingly, the Al crystalline aggregate would be covered with such an inverse segregation layer of In. Thus any oxidation of the surface of the Al crystalline grain can be suppressed and an Al composite material can thus be produced, which has such a structure that In is brought into direct contact with Al. Accordingly, the inverse segregation layer of In present in the Al composite material according to the present invention may undergo the acceleration of the ionization of Al in the presence of moisture, while the layer per se undergoes shrinkage to thus form and hold the novel direct Al—In linkages and the ionization of Al can thus be sustained. The ionized Al has a low solubility in water, immediately forms AlOOH and is then precipitated and accordingly, it never causes any ionic saturation in water and this may be helpful to maintain the reaction. In other words, when exposing the substrate on which an Al spray-coated film has been formed according to the foregoing procedures to a moisture-containing atmosphere such as an atmosphere containing water, water vapor or an aqueous solution, the Al present in the spray-coated film comes in close contact with the moisture and initiates its disintegration, the amount of the film is gradually reduced and the film finally disappears from the surface of the substrate.

The foregoing spray-coated Al film can typically be prepared according to the following procedures: Al is admixed with In and/or Sn, or an In—Sn alloy in a mixing ratio ranging from 0.1 to 20% by mass, these substances are molten together to uniformly disperse the In and/or Sn, or the In—Sn alloy in the Al matrix; the resulting uniform molten mixture is formed into a rod or a wire to thus form a thermal spray material; and then the surface of a component member for a film-forming chamber such as a baffle plate for a film-forming apparatus is covered with an Al composite film by spraying the molten mixture on the surface within a non-oxidizing atmosphere according to the flame spraying technique to thus quench and solidify the molten mixture. Thus, an intended component member for a film-forming chamber can be prepared, which is provided with a water-collapsible thermally sprayed Al film on the surface thereof. As has already been discussed above, the spray-coated film thus prepared consists of an Al—In composite material comprising a single or a plurality of Al crystalline grains and an inverse segregation layer which is a film of In and/or Sn, or an In—Sn alloy and which covers the external surface of the crystalline grains.

As has been described above, the Al spray-coated film can be disintegrated or collapsed by dipping a substrate covered with such an Al spray-coated film in a warm water or by spraying water vapor on such a substrate. For instance, when the substrate is immersed in warm water, the hydrogen gas-generating (or film-disintegration) reaction is initiated immediately after the immersion, while vigorously generating hydrogen gas, the warm water is gradually blackened due to the In and/or Sn or the Al—In alloy separated out of the spray-coated film on the substrate as the reaction further proceeds and, finally, the spray-coated film is completely disintegrated and AlOOH, In and/or Sn or the Al—In alloy remain in the warm water in the form of precipitations. The higher the temperature of the water, the more vigorous the film-disintegration reaction. In addition, this reaction proceeds at a lower temperature in proportion to the quantity of the inverse segregation layer or those of In and/or Sn or Al—In alloy. These facts will be apparent from the data plotted on FIG. 2(*a*), which show the solubility characteristics of each sample (the time (min) required for the complete dissolution of each sample) at each predetermined temperature observed when immersing an Al—In (1%) spray-coated film having a thickness of 100, 200 or 300 μm in warm water having a temperature of 50° C., 60° C., 80° C. or 100° C.; and FIG. 2(*b*) which show the solubility characteristics of each sample (the time (min) required for the complete dissolution of each sample) at each predetermined temperature observed when immersing an Al—In (5%) spray-coated film having a thickness of 100, 200 or 300 μm in warm water having a temperature of 50° C., 60° C., 80° C. or 100° C.

The foregoing spray-coated film is prepared according to the flame spray-coating technique using a rod-like or wire-like material, but it may likewise be prepared according to the flame spray-coating technique using a powdery raw material or further the film may be prepared according to the arc spray-coating technique or the plasma spray-coating technique. In the present invention, a spray-coated film is prepared by melting the foregoing raw material and then spraying the molten raw material on the surface of a substrate to quench and solidify the same using any one of the foregoing spray-coating techniques under the known process conditions.

Therefore, if this water-collapsible Al film is applied onto the surface of, for instance, a component member for a film-forming chamber such as a baffle plate or a shutter arranged within the film-forming chamber of a film-forming apparatus, the film formed by the inevitable deposition of the film-forming material on the surface of such a component member can easily be peeled off from the component member and these valuable metals can thus easily be recovered.

In this case, the peeling agent (or solution, liquid) used herein is not a chemical agent, but is simply water such as pure water, water vapor or an aqueous solution and therefore, such a component member for film-forming chambers such as a baffle plate can be protected from suffering any damage due to the dissolution thereof in the peeling agent used and accordingly, the number of the repeated use of the same would considerably be increased as compared with the case in which chemicals are used as such peeling agents. In addition, any chemical is not used in the recovery of valuable metals and this would in turn result in the substantial reduction of the processing cost and the avoidance of any environmental pollution. Moreover, the present invention has such a merit that most of film-forming materials possibly deposited on a component member for film-forming chambers such as a baffle plate are insoluble in water and the materials can easily be recovered as substances having the same compositions as those of the film-forming materials initially used and in the form of solids having the same shapes. According to the present invention, not only the recovery cost can markedly be reduced, but also the process for the recovery can greatly be simplified and therefore, wide variety of materials can be recovered by the method. For instance, the film-forming material is an expensive substance such as a precious metal, such a precious metal can easily be recovered by applying a film consisting of the Al alloy of the present invention onto the surface of a component member for film-forming chambers such as a baffle plate. More specifically, the application of such an Al alloy film to the component member would permit the easy removal or recovery of the film consisting of film-forming materials inevitably deposited on the member during the film-forming operations by simply immersing the member in water or by spraying water vapor on the member. Thus the present invention permits the recovery of the film-forming materials without being accompanied by any contamination of the materials. This recovery method permits the reduction of the recovery cost and the recovery of the film-forming materials in their high quality conditions.

Furthermore, the water-collapsible Al powder according to the present invention can be prepared by preparing a molten metal in which In and/or Sn or an In—Sn alloy is uniformly dispersed in an Al matrix in an amount ranging from 0.1 to 20% by mass, while making use of the turbulent effect encountered within an induction furnace and then spraying the resulting molten metal within a non-oxidizing atmosphere according to the known atomizing technique to thus quench and solidify the sprayed molten metal.

Now, the generation of hydrogen gas and the anodic protection will hereunder be described in detail.

The conventional hydrogen-generating alloy material requires the use of an aqueous solution, but the water-collapsible Al composite material according to the present invention permits a large quantity of hydrogen gas even when using water and water vapor in addition to an aqueous solution. This Al composite material can react with water or water vapor. In other words, this Al composite material is separated into boehmite (AlOOH) and elemental In, which undergo precipitation, while the Al in the composite material reacts with water to decompose the same and to thus generate hydrogen gas. The elemental In can be recovered without any additional treatment and can be reused. This reaction may vary by the control of the In content in the Al composite material and the dispersed condition thereof in the material and therefore, the quantity of hydrogen gas generated through the reaction can widely be controlled. For this reason, the Al composite material can appropriately be designed depending on particular purposes. For instance, it may be designed so as to satisfy the following requirements: hydrogen gas should be generated in a large amount; and hydrogen gas should be generated over a very long period of time. In addition, a by-product of the hydrogen gas-generating reaction is boehmite and the latter is never converted into a colloidal state and therefore, the reaction solution can easily be handled. The resulting boehmite can be used as, for instance, a raw material for preparing zeolite.

The Al composite material of the present invention also shows extremely low electrode potential characteristics in water as compared with that of the conventional Al—In alloy material and therefore, the reaction thereof with water is accelerated and activated and the reaction can stably be continued or sustained over a long period of time. Accordingly, the Al composite material of the present invention has a highly improved, so-called sacrificial anodic effect and the Al composite material can widely be used for the purposes of anodic protection.

The present invention will be described below in detail with reference to the following non-limitative working Examples, but the present invention is not restricted to these specific Examples at all.

Example 1

Metals Al and In were admixed together in a mixing ratio of 99:1 (wt %) or 95:5 (wt %); the resulting mixture was melted to thus uniformly disperse In within an Al matrix; the melt was formed into a rod-like shaped product serving as a material for the spray coating method; and then a spray-coated film was formed on the surface of a baffle plate used in a film-forming apparatus using the rod-like spray-coating material prepared above according to the molten rod type flame spray-coating technique. In this respect, the flame spray-coating technique was carried out within a non-oxidizing atmosphere. An SEM micrograph of each spray-coated film thus formed is shown in the attached FIG. 3. In this connection, FIG. 3(*a*) shows such an SEM micrograph of a spray-coated film consisting of Al—In (1%) and FIG. 3(*b*) shows such an SEM micrograph of a spray-coated film consisting of Al—In (5%). As will be clear from the data shown in FIGS. 3(*a*) and 3(*b*), both of these two kinds of spray-coated films are water-collapsible Al—In composite materials each having a structure as shown in FIG. 1.

Further, as will likewise be clear from the data shown in FIGS. 4(*a*) to 4(*b*), which show EPMA images observed on the rupture surface of the Al spray-coated films prepared above, the inverse segregation layer of In covers the external surface of a single and/or a plurality of Al crystalline grains. In this respect, FIG. 4(*a*) shows the reflection electron diffraction image observed for the Al—In (1%) film and the characteristic X-ray image of In, while FIG. 4(*b*) shows the reflection electron diffraction image observed for the Al—In (5%) film and the characteristic X-ray image of In.

In addition, the same procedures used above were repeated except for using Sn in place of In to thus prepare Al—Sn (2%) spray-coated film. This spray-coated film was found to be a water-collapsible Al—Sn composite material having a structure and a composition similar to those described above, like the foregoing Al—In spray-coated film.

Example 2

A substrate covered with an Al—In (1%) spray-coated film identical to that prepared in Example 1 was dipped in warm water maintained at 60° C. Thus, the following results were observed, as shown in the attached FIGS. 5(*a*) to 5(*c*): (a) the reaction of the film with water initiated immediately after the dipping of the substrate in the warm water, while hydrogen gas was generated vigorously; (b) as the reaction further proceeded, the water was blackened due to In separated out from the film and dispersed in the warm water; and (c) finally, the alloy film was peeled off from the substrate and it was lifted out of the water. The results clearly indicate that the spray-coated film was collapsed in water, and could not be deposited on the substrate any more and peeled off from the same. Thus it would be concluded that the Al alloy film of the present invention is a water-collapsible film.

Example 3

Platinum (Pt) films were formed on the surface of substrates using a sputtering apparatus equipped with a baffle plate whose surface had been covered with an Al—In (5%) spray-coated film (film thickness: 200 μm) prepared according to the procedures similar to those used in Example 1, the baffle plate provided thereon with a Pt film was detached from the film-forming apparatus and treated with warm water maintained at a temperature of 60° C. As a result, it was found that the spray-coated film was disintegrated within 10 minutes and the Pt film deposited on the baffle plate was peeled off from the plate. Thus, the film-forming material or Pt could easily be recovered. At this stage, it was found that AlOOH was precipitated in the warm water.

INDUSTRIAL APPLICABILITY

If the water-collapsible Al composite material according to the present invention is used for covering the surface of a component member for the film-forming chamber of a vacuum film-forming apparatus, which is used for forming a thin film of a metal or a metal compound on a semiconductor or electronics-related machinery and tools according to, for instance, the sputtering technique, the vacuum evaporation technique, the ion-plating technique and the CVD technique, the film inevitably deposited on the surface of this component member for the film-forming chamber during the film-forming process can be peeled off from the member in a moisture-containing atmosphere and can thus be recovered. Accordingly, the present invention is quite useful for the recovery of film-forming materials in the fields which make use of these film-forming apparatuses.

What is claimed is:

1. A water-collapsible Al film formed on a component member for a film-forming chamber and that consists essentially of particles constructed from a single or a plurality of crystalline grains of Al or an Al alloy, comprising:

a film of a low melting point metal or alloy selected from the group consisting of In, combinations of In and Sn, and alloys thereof, covering an external surface of the water-collapsible Al film, whereby when film-forming materials have been deposited on the surface of the water-collapsible Al film on the component member after film-forming processes, and the component member with the water-collapsible Al film formed thereon is exposed to a humid environment, the water-collapsible Al film dissolves, thereby removing the deposited film-forming materials without damage to the component member.

2. The combination as set forth in claim 1, wherein the content of the In, a combination of In and Sn or an alloy thereof in the water-collapsible Al film ranges from 0.1 to 20% by mass on the basis of the total mass of the film.

* * * * *